US006543603B2

(12) United States Patent
Spatafora et al.

(10) Patent No.: US 6,543,603 B2
(45) Date of Patent: Apr. 8, 2003

(54) UNIT FOR TRANSFERRING ARTICLES

(75) Inventors: Mario Spatafora, Bologna (IT); Loris Grepioni, Castel Maggiore (IT)

(73) Assignee: G.D Societa' per Azioni, Bologna (IT)

( * ) Notice: Subject to any disclaimer, the term of this patent is extended or adjusted under 35 U.S.C. 154(b) by 0 days.

(21) Appl. No.: 09/927,990

(22) Filed: Aug. 10, 2001

(65) Prior Publication Data

US 2002/0020606 A1 Feb. 21, 2002

(30) Foreign Application Priority Data

Aug. 16, 2000 (IT) ..... BO2000A0495

(51) Int. Cl.[7] ..... B65G 25/00; B65G 47/26

(52) U.S. Cl. ..... 198/429; 198/573; 198/468.9; 198/426

(58) Field of Search ..... 198/426, 429, 198/431, 468.9, 573

(56) References Cited

U.S. PATENT DOCUMENTS 4,750,607 A * 6/1988 Focke ..... 131/283
5,070,991 A * 12/1991 Hinchcliffe et al. ..... 198/418.3
5,775,054 A * 7/1998 Boldrini ..... 131/281
5,979,458 A * 11/1999 Meis ..... 131/105
6,085,494 A * 7/2000 Lembke et al. ..... 53/228
6,269,931 B1 * 8/2001 Tale' et al. ..... 198/418.3
6,385,947 B2 * 5/2002 Meis ..... 53/148

* cited by examiner

*Primary Examiner*—Christopher P. Ellis
*Assistant Examiner*—Richard Ridley
(74) *Attorney, Agent, or Firm*—Marshall, Gerstein & Borun

(57) ABSTRACT

A unit for transferring groups of cigarettes has a conveyor having pockets for housing the groups and for feeding the groups in a first direction; a guide for guiding each group into a respective pocket along a path in a second direction crosswise to the first direction; and a safety device having a guide member adjacent to the conveyor and movable between a work position defining part of the path, and an emergency position remote from the path; the unit also having a spring for setting the guide member to the emergency position when a group of cigarettes transmits to the guide member a force over and above a given threshold value.

14 Claims, 6 Drawing Sheets

UNIT FOR TRANSFERRING ARTICLES

The present invention relates to a unit for transferring articles.

More specifically, the present invention relates to a unit for transferring groups of cigarettes on a cigarette packaging machine, to which the following description refers purely by way of example.

BACKGROUND OF THE INVENTION

Cigarette packaging machines provide for forming groups of normally twenty cigarettes, and for packaging the groups in packaging material. In one packaging machine, the cigarettes are housed in bulk inside a hopper having a number of substantially vertical outlets, down which the cigarettes are fed by force of gravity on to a plate on which a group of cigarettes is formed.

The machine comprises a transfer unit having a pocket conveyor for feeding the groups in a given first direction; a pusher for each outlet, to expel the groups of cigarettes from the hopper outlet in a second direction perpendicular to the first direction; and, for each outlet, a guide located between the outlet and the conveyor and aligned with the hopper outlet to guide the groups of cigarettes into a conveyor pocket along a path parallel to the second direction.

The conveyor cyclically arrests a pocket at each guide, and, while the pockets are stationary, the pushers transfer respective groups of cigarettes through the respective guides from the outlets to the pockets. Once the groups are transferred from the outlets to the respective pockets, the pockets are fed forward in the first direction to transfer the groups to packaging wheels on the machine to wrap the groups in respective sheets of packaging material to form packets of cigarettes.

When any one of the pushers, for any reason, fails to complete its travel, so that the group of cigarettes is located partly inside the pocket and partly inside the guide, the forward movement of the pocket in the first direction subjects the group to shearing stress, which is opposed strongly by the group of cigarettes, on account of the guide having compressed the cigarettes together, so that the group acts substantially as a single body and is resistant enough to cause failure of the weaker or less firmly connected structural elements. In the case in question, the worst damage is caused to the pocket, which breaks away from the conveyor.

The above drawback is further compounded by the pocket having to be fitted back on to the conveyor, which means arresting the whole unit, and consequently the machine as a whole, for relatively long periods.

SUMMARY OF THE INVENTION

It is an object of the present invention to provide a unit for transferring articles, designed to eliminate the above drawback of known transfer units, and which in particular need not be arrested in the event of incomplete transfer of the article.

According to the present invention, there is provided a unit for transferring articles, in particular groups of cigarettes; the unit comprising a conveyor having at least one pocket for housing the articles and for feeding the articles in a first direction; and a guide for guiding the articles into a said pocket along a transfer path in a second direction crosswise to said first direction; and the unit being characterized by comprising a safety device comprising a guide member adjacent to the conveyor and movable between a work position defining part of the transfer path, and an emergency position remote from the transfer path; and a first actuator for setting the guide member to the emergency position when the articles transmit to the guide member a force over and above a threshold value.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
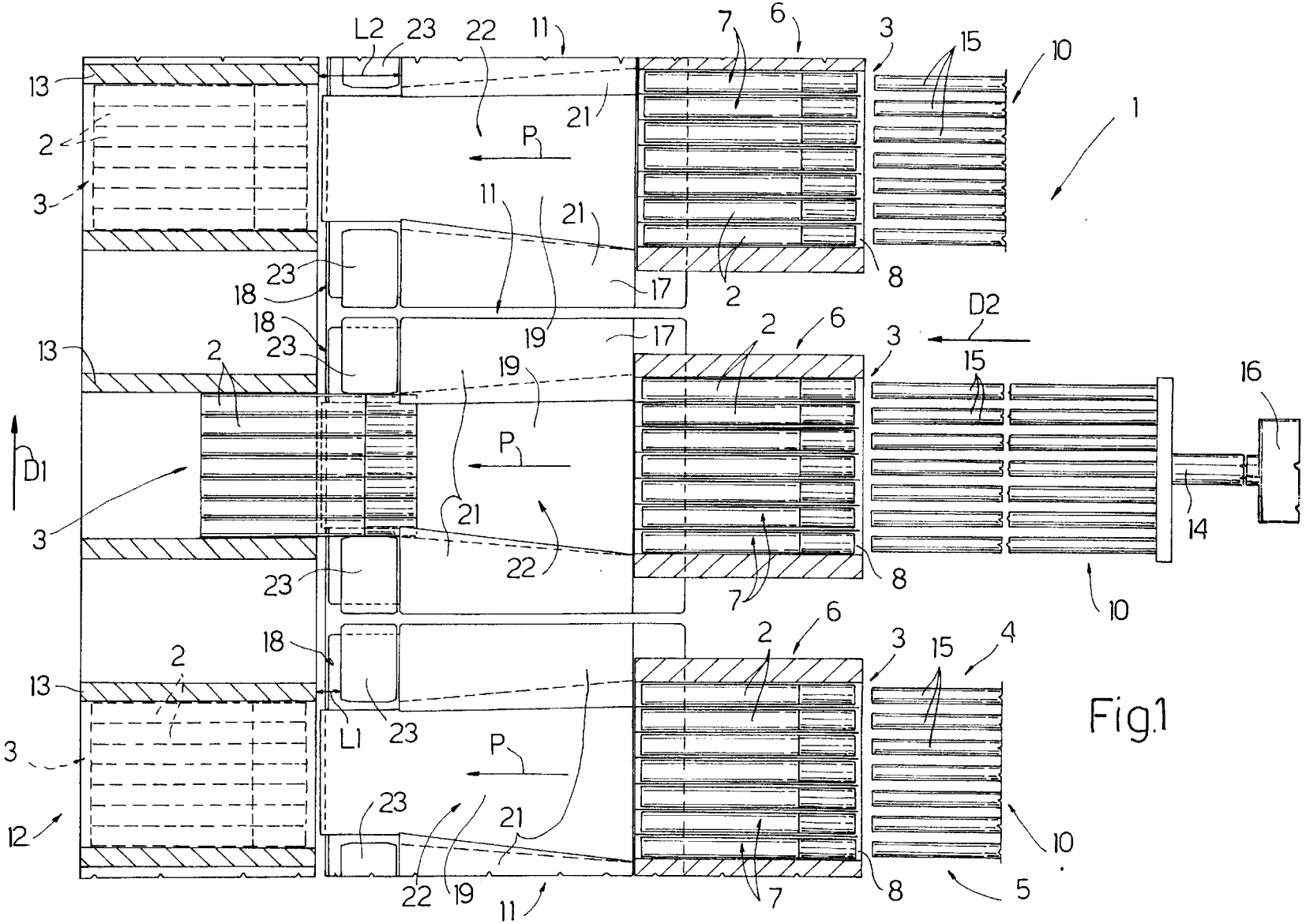
FIG. 1 shows a plan view, with parts in section and parts removed for clarity, of a packaging machine comprising a transfer unit in accordance with a preferred embodiment of the present invention.
Figure 2:
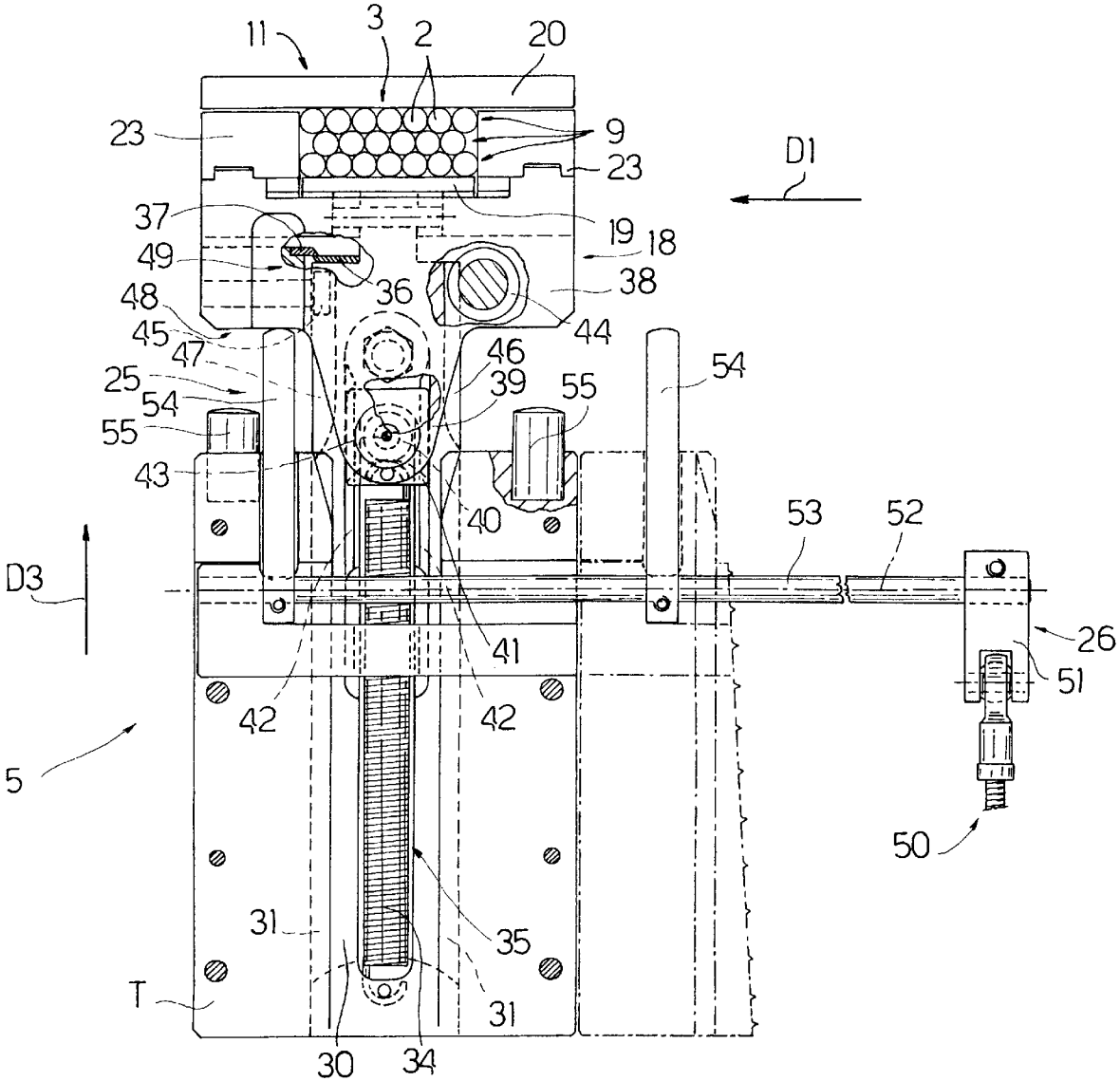
FIG. 2 shows a front view, with parts in section and parts removed for clarity, of a detail of the FIG. 1 unit.

With reference to FIGS. 1 and 2, number 1 indicates as a whole a machine for packaging cigarettes 2, and which arranges the cigarettes in groups 3 and Is wraps groups 3 in respective sheets of packaging material not shown. Machine 1 comprises a frame T supporting a hopper 4 for receiving cigarettes 2 in bulk and forming groups 3; and a transfer unit 5 for transferring groups 3. Hopper 4 comprises a number of outlets 6, each of which comprises feed channels 7 for cigarettes 2, and a bottom supporting plate 8 for arresting cigarettes 2. The cigarettes 2 contacting plate 8 form a bottom layer 9, on top of which are formed successive layers 9 of cigarettes; and a group 3 of cigarettes 2 comprises three superimposed layers 9, which are subsequently compressed to compact cigarettes 2 as far as possible.

Transfer unit 5 comprises a pusher 10 located at each outlet 6; a guide 11 located on the opposite side of outlet 6 to pusher 10; and a conveyor 12, in turn comprising a number of pockets 13 fed in a direction D1. Pusher 10 comprises a rod 14; and fingers 15, which are inserted inside the various channels 7 to expel a group 3 from outlet 6 and transfer group 3 through guide 11 into a pocket 13 arrested in front of guide 11. Each pusher 10 is operated independently of the other pushers 10 by a respective linear actuator 16, which moves pusher 10 back and forth in a direction D2 perpendicular to direction D1.

With reference to FIGS. 3 to 6, guide 11 comprises a tubular sleeve 17 adjacent to hopper 4; and a guide member 18 adjacent to conveyor 12. Tubular sleeve 17 comprises a bottom wall 19; a top wall 20 parallel to bottom wall 19; and two lateral walls 21 perpendicular to walls 19 and 20 and converging in direction D2, from outlet 6 towards conveyor 12, to form a tapering channel 22 for compacting cigarettes 2 in each group 3 fed through guide 11. Guide member 18 defines two parallel, facing lateral walls 23, which, in use, are adjacent to walls 19 and 20 and project towards conveyor 12 with respect to lateral walls 21.

Bottom wall 19 of sleeve 17 projects with respect to lateral walls 21 towards hopper 4, and forms a supporting surface for cigarettes 2 together with plate 8.

Transfer unit 5 comprises, for each guide 11, a tipping device 24 connecting sleeve 17 to frame T; and a safety device 25 comprising guide member 18 of guide 11 and fitted to tipping device 24. Unit 5 also comprises a reset device 26 common to all of guides 11.

Tipping device 24 comprises a rod 27, which is located beneath sleeve 17 and is connected to a point along bottom wall 19 of sleeve 17 by a hinge 28 having an axis parallel to direction D1, and to a point on frame T by a hinge 29 also having an axis parallel to direction D1.

Device 24 also comprises a slide 30, which is fitted to slide along a guide 31 integral with frame T and extending in a vertical direction D3, and is connected to a point along bottom wall 19 of sleeve 17 by a hinge 32 having an axis parallel to direction D1.

Device 24 also comprises an actuator 33 extending along guide 31 and having one end fixed to frame T and the other end fixed to slide 30.

In addition to guide member 18, safety device 25 also comprises a spring 34; a slot 35 housing spring 34 and formed in slide 30; and two teeth 36 and 37 integral with slide 30 and guide member 18 respectively. With reference to FIG. 2, guide member 18 comprises a central body 38, from which the two walls 23 project upwards, and from which projects downwards a projection 39 connected by a pin 40 to a slide 41 running in a guide 42 formed on slide 30. Projection 39 and slide 41 are connected by pin 40, which allows guide member 18 to oscillate about an axis 43 of pin 40 parallel to direction D2. Guide member 18 supports two rollers 44 and 45 located on opposite sides of slide 30 and loosely engaging respective guides 46 and 47 formed in slide 30 and which restrict the oscillation of guide member 18 to a few degrees. Each guide member 18 comprises a bottom surface 48 of central body 38; and an elongated slot 49 formed in central body 38 and which comes out at surface 48.

Figure 3:
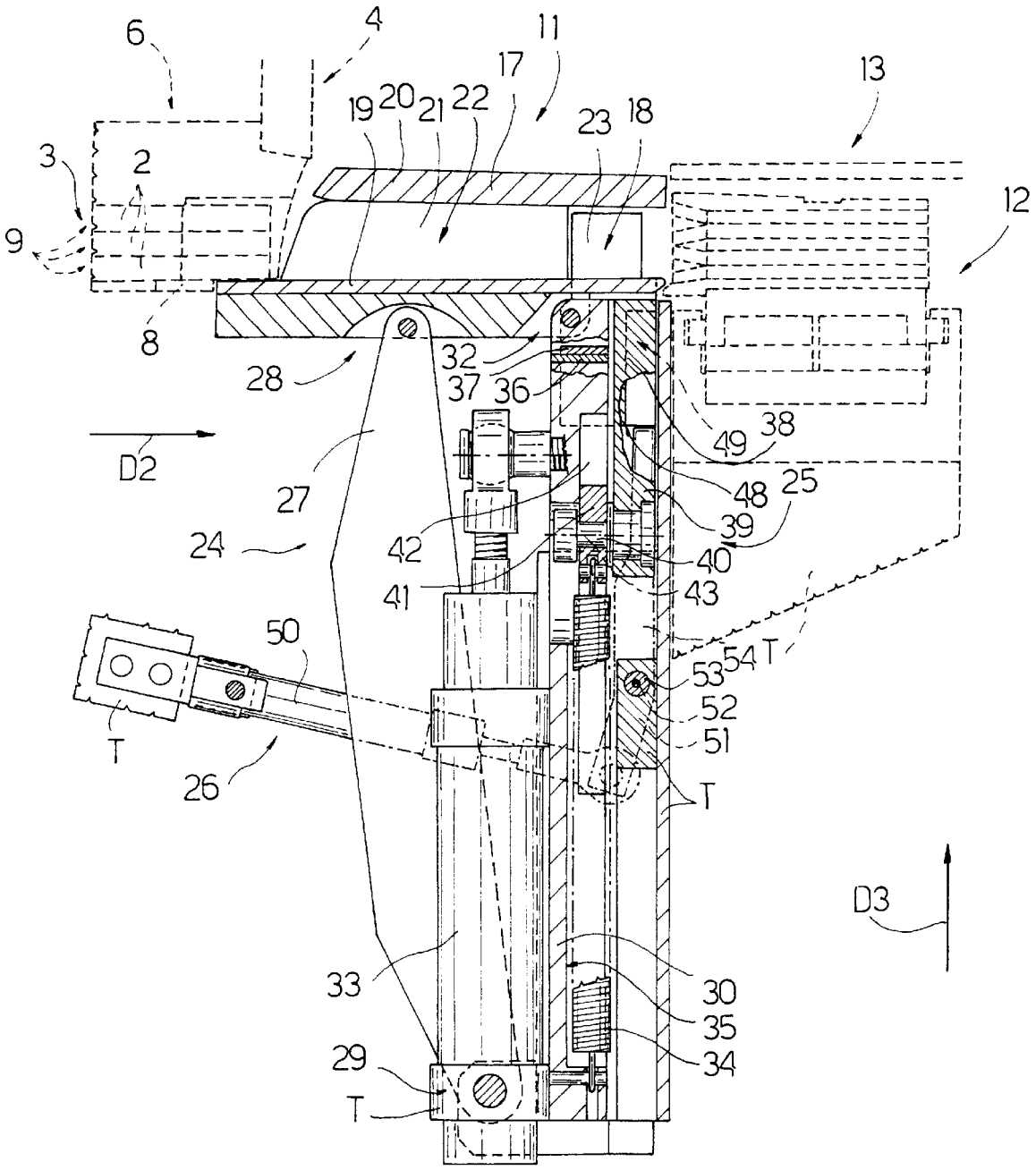
FIGS. 3 to 6 show side views, with parts in section and parts removed for clarity, of a detail of the FIG. 1 unit at successive stages respectively comprising a work stage, an emergency stage, a maintenance stage, and a reset stage.
Figure 4:
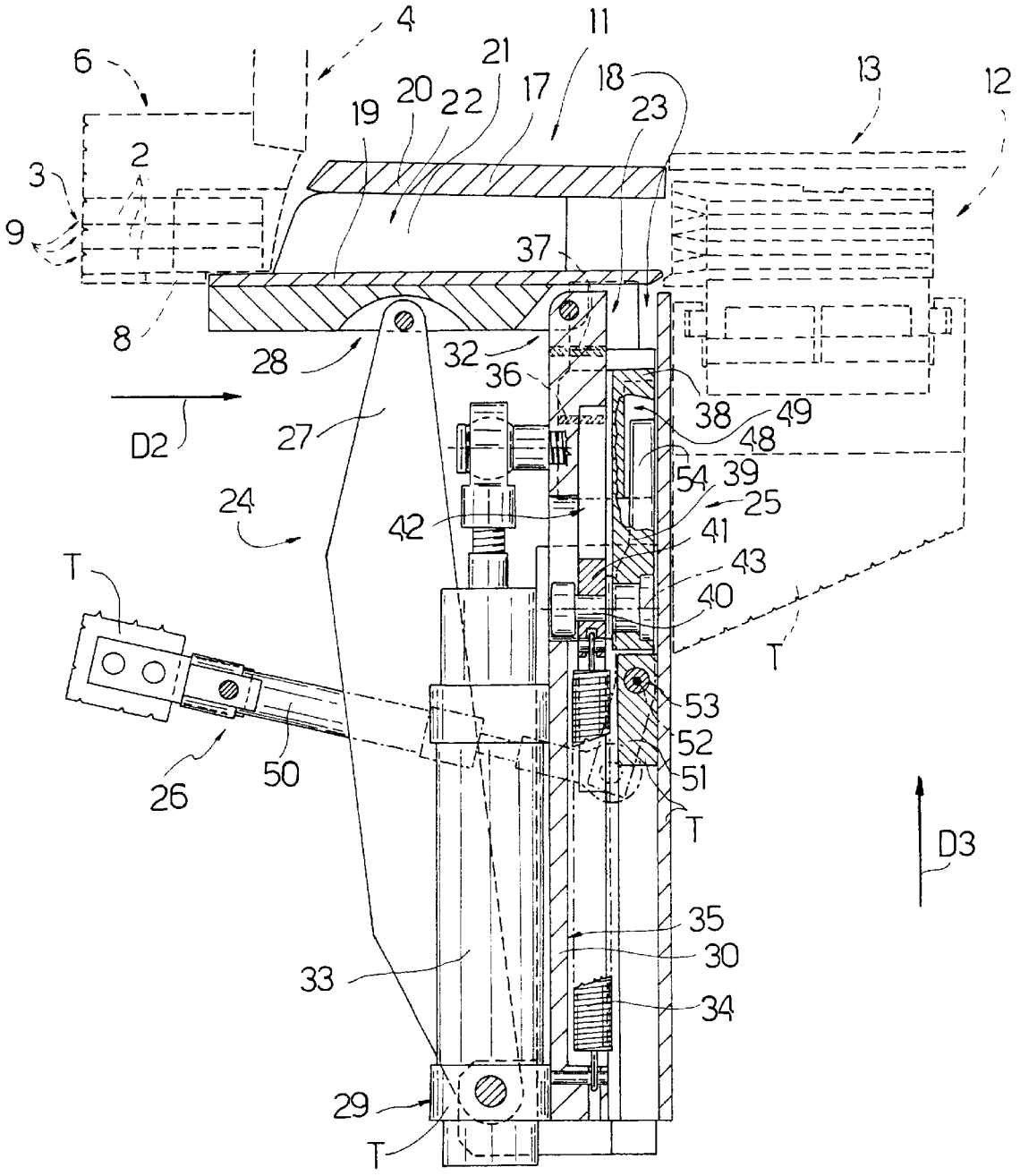
Figure 5:
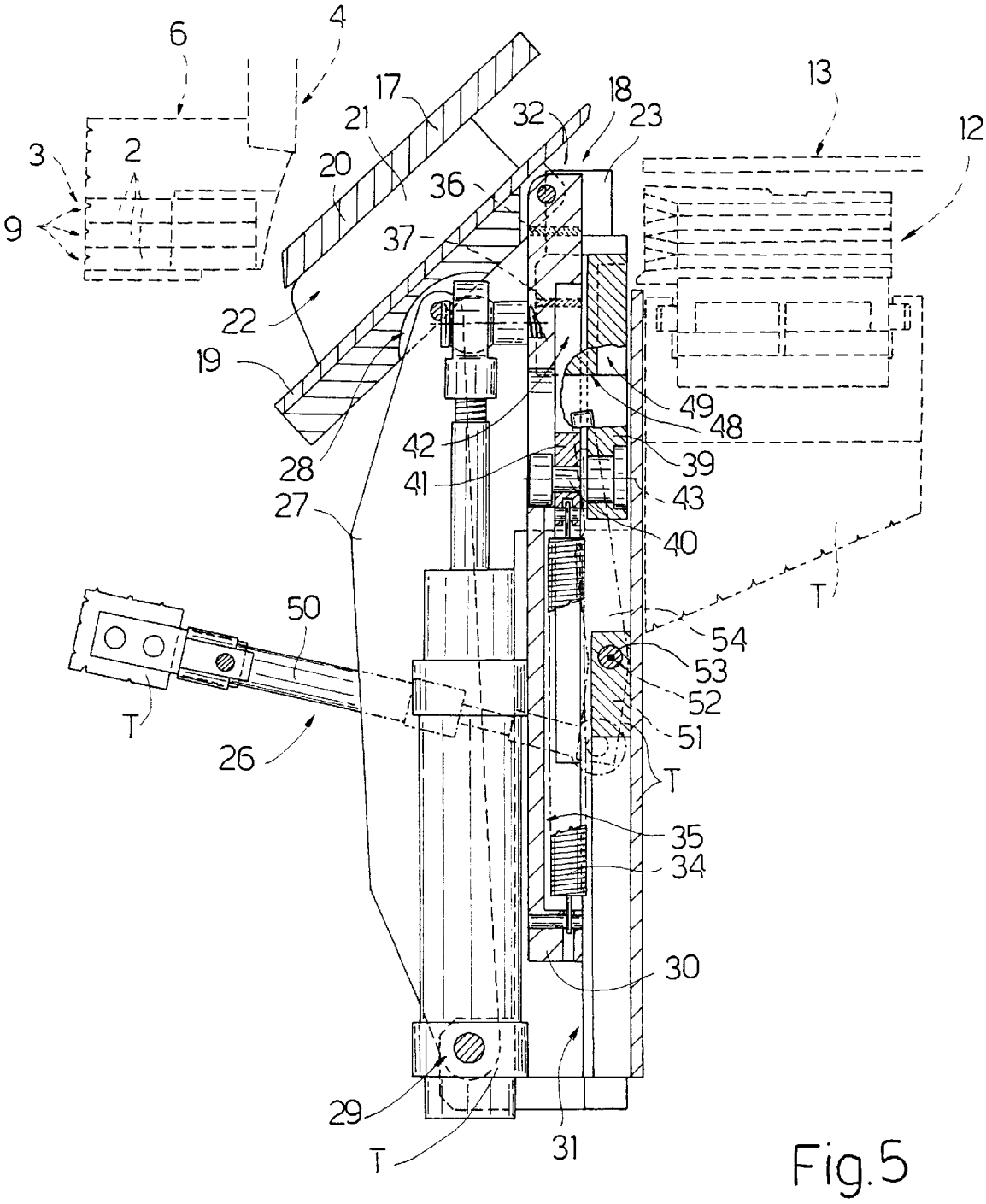
Figure 6:
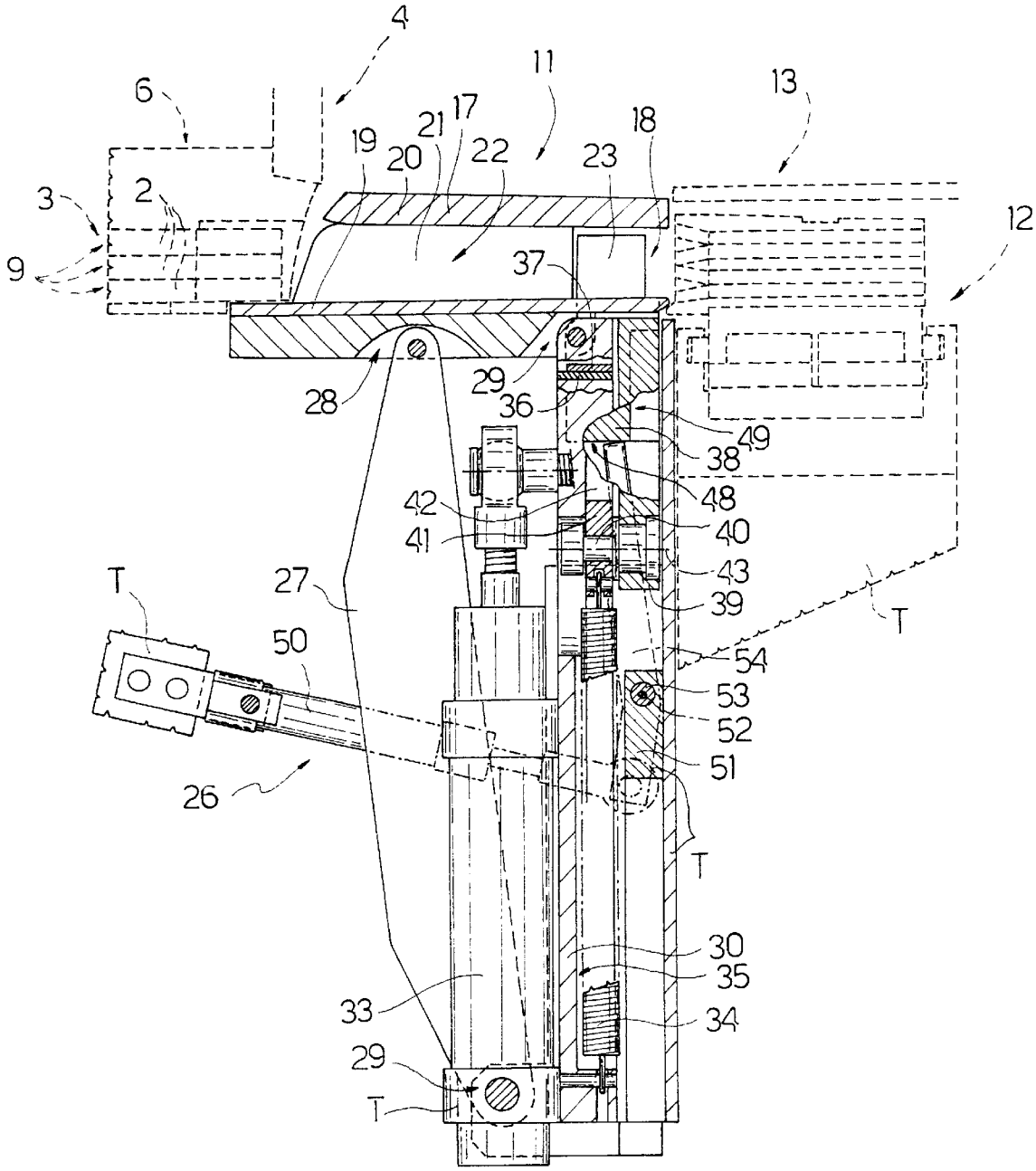

With reference to FIG. 2 and FIGS. 3 to 6, reset device 26 comprises a linear actuator 50 having one end integral with frame T and the other end hinged to a crank 51, which rotates with respect to frame T about an axis 52 parallel to direction D1, and is integral with a shaft 53 extending parallel to axis 52 at each safety device 25. Reset device 26 comprises a number of rods 54, each of which is located at a respective guide member 18, is integral with shaft 53, and rotates about axis 52 between a rest position engaging slot 49 as shown in FIG. 4, and a work position resting against surface 48 to brace guide member 18 as shown in FIG. 6.

Unit 5 also comprises rubber pads 55 for cushioning the impact of guide member 18 when withdrawn by spring 34.

In actual use, and with reference to FIG. 1, groups 3 of cigarettes are transferred by pushers 10 from respective outlets 6 to pockets 13 through guide 11 along a transfer path P parallel to direction D2. At this stage, sleeve 17 and guide member 18 are in the work position (FIG. 3) and together define guide 11 and path P. In the event any one of pushers 10 fails to complete its travel, owing to a malfunction of respective actuator 16 or to blockage of outlet 6, the group 3 of cigarettes may assume the position shown in the central outlet in FIG. 1, i.e. astride guide 11 and pocket 13, so that, when conveyor 12 feeds pockets 13 in direction D1, group 3 reacts with a force opposing motion and exerts a force in direction D1 on wall 23 of guide member 18. Given the extremely small distance L1 between walls 23 and pocket 13, the force subjects group 3 to what is tantamount to shearing stress, is resisted strongly by group 3, owing to the cigarettes 2 in group 3 reacting to the shearing stress, not singly, but as a body, and is transmitted by group 3 to wall 23.

With reference to FIG. 2, the force exerted on wall 23 rotates guide member 18 anticlockwise, in FIG. 2, about axis 43; which rotation is limited by rollers 44 and 45 engaging respective guides 46 and 47, but is sufficient to release teeth 36 and 37 so that spring 34 withdraws guide member 18 downwards in direction D3. Guide member 18 is guided, by slide 41 engaging guide 42 and by rollers 44 and 45 engaging respective guides 46 and 47, into an emergency position (FIG. 4) in which walls 23 of guide member 18 are set, with respect to transfer path P, to a remote position in which they form no part of guide 11.

With reference to FIG. 1, once guide member 18 is lowered into the emergency position beneath bottom wall 19 of sleeve 17, walls 21 of sleeve 17 are located a distance L2 from pocket 13 and the force exerted on group 3 is tantamount to a bending moment to which cigarettes 2 react singly by bending to allow conveyor 12 to move forward. The change in the reaction of cigarettes 2 in group 3 is due to cigarettes 2, at this stage, having room to deform and turn inwards under the bending moment.

In FIG. 3, transfer unit 5 is set to the work position, teeth 36 and 37 are mutually engaged, and rods 54 are located beneath and aligned with respective slots 49. When teeth 36 and 37 are released by the force transmitted by a partly transferred group 3, guide member 18 is lowered by spring 34 into the FIG. 4 emergency position in which rod 54 engages the slot 49 of the released guide member 18, and sleeve 17 is set to the work position. At this stage, slide 41 is located at the bottom of respective guide 42.

With reference to FIG. 5, following a command from a central control unit (not shown) and determined by a sensor (not shown) for detecting the position of guide member 18, actuator 33 of tipping device 24 is operated to move slide 30 upwards in direction D3 and tip sleeve 17 about hinges 28 and 29 into a maintenance position. When slide 30 and sleeve 17 are set to the maintenance position, guide member 18 remains in the same position with respect to slide 30, but changes position with respect to conveyor 12 and is set above the work position. In other words, the upward movement of slide 30 is greater than the downward movement of guide member 18 with respect to slide 30. At this stage, actuator 50 of reset device 26 is operated to set rods 54 to the respective work positions. The rod 54 engaging slot 49 is released by the upward movement of member 18 together with slide 30, and is rotated about axis 52 into the work position.

With reference to FIG. 6, after clearing any cigarettes 2 from outlet 6 and sleeve 17, the operator activates actuator 33 to restore sleeve 17 and guide member 18 to the work position. Actuator 33 is withdrawn and slide 30 is lowered in direction D3 to set sleeve 17 to the work position. As it moves down, the released guide member 18 rests on rod 54, and, as slide 30 moves down, changes position with respect to slide 30 so that tooth 37 of guide member 18 engages tooth 36 of slide 30. Teeth 36 and 37 are allowed to engage by rod 54 being located on the same side of axis 43 as teeth 36 and 37, so as to produce a clockwise rotation in FIG. 2 upon guide member 18 contacting rod 54. In other words, rod 54 keeps tooth 37 in a position of interference with respect to tooth 36. As shown in FIG. 2, teeth 36 and 37 have respective beveled ends, so that tooth 37, on contacting tooth 36 as slide 30 moves down, produces a clockwise rotation about axis 43 in FIG. 2 to clear tooth 36, and is then restored to the interference position by rod 54. When slide 30 reaches the bottom limit position, tooth 37 rests on tooth 36 and is once more held against tooth 36 by spring 34.

Actuator 50 is then withdrawn and rods 54 are again positioned at respective slots 49.

The unit described has the advantage of avoiding any stoppage of the packaging machine in the event of incomplete transfer of a group, and of enabling the cigarettes clogging the guide or hopper outlet to be removed easily without stopping the machine, which continues operating to a lesser degree as the operator repairs the pusher and removes the cigarettes clogging the outlet and/or guide.

What is claimed is:

1. A unit for transferring articles, in particular groups (3) of cigarettes; the unit (5) comprising a conveyor (12) having at least one pocket (13) for housing the articles (3) and for feeding the articles (3) in a first direction (D1); and a guide (11) for guiding the articles (3) into said at least one pocket (13) along a transfer path (P) in a second direction (D2) crosswise to said first direction (D1); and the unit (5) being characterized by comprising a safety device (25) comprising a guide member (18) adjacent to the conveyor (12) and movable between a work position defining part of the transfer path (P), and an emergency position remote from the transfer path (P); and a first actuator (34) for setting the guide member (18) to the emergency position when the articles (3) transmit to the guide member (18) a force over and above a threshold value.

2. A unit as claimed in claim 1, characterized in that said guide member (18), in said work position, is set to a position of equilibrium with respect to a support (30); said force altering said position of equilibrium.

3. A unit as claimed in claim 1, characterized in that said force comprises at least one component in the first direction (D1).

4. A unit as claimed in claim 2, characterized in that said support (30) comprises a first tooth (36), and said guide member (18) comprises a second tooth (37) engaging the first tooth (36) in said position of equilibrium.

5. A unit as claimed in claim 4, characterized in that said guide member (18) is connected to said support (30) by said first actuator (34); said first actuator (34) pushing the first and the second tooth (36, 37) against each other, and withdrawing said guide member (18) into said emergency position.

6. A unit as claimed in claim 4, characterized in that said guide member (18) is movable, with respect to said support (30), in a third direction (D3) perpendicular to the first and second direction (D1, D2), and rotates with respect to said support (30) about an axis (43) parallel to said second direction (D2); said force rotating said guide member (18) with respect to said support (30) to release said second tooth (37) from said first tooth (36).

7. A unit as claimed in claim 6, characterized in that said guide member (18) is mounted to rotate about said axis (43) with respect to a first slide (41) sliding with respect to said support (30); said first actuator (34) being a spring (34) connecting said first slide (41) to said support (30).

8. A unit as claimed in claim 6, characterized in that said guide member (18) comprises stops (44, 45) for restricting rotation of the guide member (18) with respect to the support (30).

9. A unit as claimed in claim 1, characterized in that said guide member (18) comprises two lateral walls (23) forming part of said guide (11) in said work position; said lateral walls (23) being adjacent to said conveyor (12).

10. A unit as claimed in claim 9, characterized in that said guide (11) comprises a sleeve (17); said lateral walls (23) being complementary to said sleeve (17) to form said guide (11).

11. A unit as claimed in claim 10, characterized in that said sleeve (17) can be tipped, by a tipping device (24), between a work position wherein said sleeve (17) partly defines the transfer path (P), and a maintenance position; said tipping device (24) comprising said support (30).

12. A unit as claimed in claim 11, characterized in that said support (30) is a second slide (30); said second slide (30) being movable in said third direction (D3) with respect to said conveyor (12) to set said sleeve (17) to said work position and to said maintenance position; said tipping device (24) comprising a second actuator (33) for changing the position of said second slide (30) with respect to said conveyor (12).

13. A unit as claimed in claim 12, characterized by comprising a reset device (26) comprising a supporting member (54) movable between a rest position and a work position to keep said guide member (18) in a fixed position with respect to said conveyor (12) while the position of said second slide (30) with respect to said conveyor (12) is changed by said second actuator (33) to restore said sleeve (17) to the work position.

14. A unit as claimed in claim 1, characterized by comprising a number of guides (11), and a safety device (25) for each guide (11).

* * * * *

UNITED STATES PATENT AND TRADEMARK OFFICE

CERTIFICATE OF CORRECTION

PATENT NO. : 6,543,603 B2
DATED : April 8, 2003
INVENTOR(S) : Spatafora et al.

It is certified that error appears in the above-identified patent and that said Letters Patent is hereby corrected as shown below:

Column 5,
Line 13, "into said at least one pocket" should be -- into a said pocket --

Signed and Sealed this

Twenty-eighth Day of October, 2003

JAMES E. ROGAN
*Director of the United States Patent and Trademark Office*